US010511919B2

(12) United States Patent
Epstein

(10) Patent No.: US 10,511,919 B2
(45) Date of Patent: Dec. 17, 2019

(54) METHODS FOR HEARING-ASSIST SYSTEMS IN VARIOUS VENUES

(71) Applicant: Barry Epstein, Dallas, TX (US)

(72) Inventor: Barry Epstein, Dallas, TX (US)

( * ) Notice: Subject to any disclaimer, the term of this patent is extended or adjusted under 35 U.S.C. 154(b) by 232 days.

(21) Appl. No.: 15/598,444

(22) Filed: May 18, 2017

(65) Prior Publication Data

US 2017/0339496 A1 Nov. 23, 2017

Related U.S. Application Data

(60) Provisional application No. 62/338,383, filed on May 18, 2016.

(51) Int. Cl.

| | |
|---|---|
| ***H04R 25/00*** | (2006.01) |
| *G10L 21/0364* | (2013.01) |
| *H04R 27/02* | (2006.01) |

(52) U.S. Cl.

CPC ..... *H04R 25/554* (2013.01); *H04R 25/505* (2013.01); *G10L 21/0364* (2013.01); *H04R 25/43* (2013.01); *H04R 27/02* (2013.01); *H04R 2225/43* (2013.01); *H04R 2227/007* (2013.01)

(58) Field of Classification Search

USPC ..... 381/318

See application file for complete search history.

(56) References Cited

U.S. PATENT DOCUMENTS

| | | | | |
|---|---|---|---|---|
| RE38,405 | E * | 1/2004 | Clair, Jr. | H04R 5/00 381/79 |
| 7,110,552 | B1 * | 9/2006 | Saliterman | H04H 20/63 381/77 |
| 7,599,507 | B2 | 10/2009 | Hansen | |
| 8,594,353 | B2 | 11/2013 | Anderson | |
| 9,055,377 | B2 | 6/2015 | Kinsbergen et al. | |
| 9,173,041 | B2 | 10/2015 | Alexander | |
| 9,191,755 | B2 | 11/2015 | Kalluri et al. | |
| 2013/0089208 | A1 * | 4/2013 | Fairey | H04R 5/04 381/17 |
| 2014/0023219 | A1 * | 1/2014 | Chao | H04R 25/353 381/320 |
| 2015/0326965 | A1 * | 11/2015 | Sprague | G10L 13/043 381/317 |

OTHER PUBLICATIONS

Marbury Law Group, "*Venue Hearing Enhancement System for the Hearing Impaired*", Pre-Filing Search Report; steven@maxval.com, pp. 1 of 13.

A. Kusumoto, et al.; "*Modulation Enhancement of Speech as a Preprocessing for Reverberant Chambers with the Hearing-Impaired*"; icsi.berkeley.edu; pp. 1 of 4.

Robert H. Breit, et al, "Improvement in speech intelligibility in noise employing an adaptive filter with normal and hearing-impaired subjects", Journal of Rehabilitation Research and Development; vol. 24, pp. 75-86.

* cited by examiner

*Primary Examiner* — Quoc D Tran

(74) *Attorney, Agent, or Firm* — Foley & Lardner LLP

(57) ABSTRACT

A hearing-assist system for use in a venue in which ambient sounds contain dialogue as well as other components which comprises circuitry inserted in a signal path between a program source feed in a program occurring in the venue and a hearing-assist unit worn by a user in that venue which reduces psychoacoustic conflict and interference between sound which is ambient in the venue and sound heard by the user via the hearing-assist unit.

23 Claims, 9 Drawing Sheets

METHODS FOR HEARING-ASSIST SYSTEMS IN VARIOUS VENUES

RELATED APPLICATION

This application claims the benefit and priority of previously filed provisional patent application U.S. Application No. 62/338,383, filed May 18, 2017 and titled "IMPROVEMENT METHODS FOR HEARING-ASSIST SYSTEMS IN VARIOUS VENUES", and the contents are incorporated by reference in their entirety.

TECHNICAL FIELD OF THE INVENTION

The present invention relates in general to psychoacoustics, and, in particular, psychoacoustics as related to hearing-assist applications, and specifically to psychoacoustics as related to hearing-assist applications in a large venue.

BACKGROUND OF THE INVENTION

The population of hearing-impaired and severely hearing-impaired youth and adults is approaching 50 million in the United States and is growing rapidly. The plight of the severely hearing-impaired can be very difficult. The ability to enjoy live theater, a religious service, or even a movie is more important than just for entertainment purposes. For children, it enables critical development and contact with the everyday world. For adults or the elderly it allows enjoyment, mental stimulation, and social contact that is important. However, due to hearing impairment, some youth and adults may no longer be able to obtain these benefits from these activities.

Hearing-assist systems, as found in venues such as churches, movie theaters, live Broadway theaters, and similar venues attempt to provide amplified sound to the hearing-impaired. Many are legally required to do so. The legal requirements do not go into any significant detail with regard to actually optimizing the sound for a hearing-impaired person. A typical venue operator (and even the sound production staff) is understandably focused on other high priority tasks, and the hearing-assist system is often described as 'the end of the food chain', in that minimal effort is made improving the hearing-assist system. Most often, the sound from the hearing-assist system is perceived by the user to be unintelligible and in frustration the user may give up and further retreats from the venue, and even society.

In an attempt to maintain social contact many hearing-impaired individuals have tried hearing-assist systems in venues such as movie theaters, live Broadway theaters, and churches without success. They have been unable to hear or understand the dialog on typical headset, T-loop, and similar hearing-assist systems and have essentially retreated from these important elements of every day society. The issue or challenge is that typical hearing-assist systems were not optimized or designed for use in these venues.

More specifically, the poor hearing-assist sound quality as perceived by the hearing-impaired person in such venues results from the fact that most hearing-assist systems appear to be designed for the home, museum, or classroom environment, perhaps because cumulatively these markets may be larger than the venues of interest herein. The hearing-assist sound is typically transmitted to a headset or hearing aid (such as a cochlear implants) by FM, infrared, magnetic, or a similar coupling. It is important to recognize that the hearing-impaired person may still hear all or portions of the venue's ambient (audience) sound directly either through one ear being good, through their natural hearing's frequency response eliminating but some sound frequencies, via a hearing aid system simultaneously picking up ambient sound such as echoes and reverberation, through low-cost headsets not reducing ambient room sound, or even through body and bone conduction of low frequency sound.

Since there is a time delay between the sound waves propagated through the air and the representations of the sound propagated electronically to a device, as well as the energies in the ambient propagated sound, there may be significant interference between the ambient sound and the hearing assisted electronic sound. This interference can be extremely confusing and is likely to render the ultimate signal actually heard by the hearing-assisted user as gibberish.

The problem for the hearing-assist user in such venues will be referred to as a psychoacoustic effect. That is, as used herein, psychoacoustics is concerned with how sound is perceived, and a psychoacoustic effect is the psychological and physiological response by a hearing-impaired hearing-assist user to receiving sound in a venue. This sound heard by the hearing-assist user can include a mix of ambient sound as well as electronically transmitted sound.

As will be discussed in greater detail below, the psychoacoustic effect for a hearing-assist user occurs in any venue where some sound heard by that user is ambient and some sound to be heard by the user is electronically transmitted. In small venues, such as in a home or a classroom or the like, this effect is not significantly affected by differences between ambient sound and electronic sound and tends to not result in the masking or garbling of effects present in the original sound; however, in large venues such as theaters, concert halls, opera houses, or the like, the effect can be sufficiently significant to noticeably degrade the person's enjoyment of the program in the venue. The prior art has not adequately addressed this issue. Further developments are therefore required.

SUMMARY OF THE INVENTION

This summary is provided to introduce a selection of concepts that are further described below in the detailed description. This summary is not intended to identify key or essential features of the claimed subject matter, nor is it intended to be used as an aid in limiting the scope of the claimed subject matter.

It is one objective of this invention to consider the elements that have been overlooked with regard to the user's psychoacoustic conflict between the ambient sound at a venue and the hearing-assisted provided sound.

It is another object of the invention to provide an economical solution to the above-noted psychoacoustic problem.

It is yet another object of the invention to provide a system which solves the above-discussed psychoacoustic problem using a system that can be retrofitted to most existing hearing-assist systems or incorporated into new systems.

The overall objective of this invention is to greatly improve sound intelligibility for the hearing-impaired person whether he/she uses only headsets or a hearing aid system which allows electronic interface to an external sound source.

A more specific overall objective of the present invention is to bridge the gap between the world of the performing arts theater or movie theater and the needs of the hearing-impaired person in that environment with regard to hearing-assist systems.

These, and other objects are achieved, by a hearing-assist system for use in a venue in which ambient sounds contain dialogue as well as other components. The hearing-assist system includes circuitry inserted in a signal path between a program source feed in a program occurring in the venue and a hearing-assist unit worn by a user in that venue which reduces psychoacoustic conflict and interference between sound which is ambient in the venue and sound heard by the user via the hearing-assist unit. The system embodying this invention recognizes and corrects the conflict that exists between the hearing-assist sound and the venue's ambient (audience) sound as perceived by the hearing-impaired hearing-assist user. The system embodying the present invention bridges the gap between audiology science and electronics and combines these two disciplines in a manner not achieved by the presently-existing art.

The system not only customizes the sound so that dialogue is emphasized while other portions of the sound program, such as bass-heavy music, is de-emphasized, or even removed, the system also introduces specific delays so that the electronically customized sound reaches the hearing-impaired hearing-assist user virtually simultaneously with sound that is ambient in the venue. Still further, the system customizes the sound signal so that low amplitude valleys and peak amplitudes are reduced, using reduction/attenuation techniques which reduce the dynamic range and allow amplification of the remaining signal, such as a companding or similar technique, such that the dynamic range of the sound is reduced. Also, the system significantly improves the signal/noise ratio and increases the available clear speech energy by increasing the amplitude of the transmitted signal.

To mitigate the problems discussed above with regard to the prior art, the following are examples of processing that the inventor has discovered that can be performed on the audio source before it is transmitted by the hearing-assist system, but have not been done by the prior art:

A. Reduction of low frequencies below approximately 300 Hz by 12 db to 15 db. Although this may appear to be a severe bass cut, the sound typically still sounds rich and balanced to the hearing-assist listener because these frequencies are still received from the house system. This is due to body conduction of low frequencies and the fact that headset isolation still tends to pass ambient low frequencies to a significant degree. By first reducing the high disturbing energy, the rest of the processing can be made more accurate, the signal to noise ratio on a transmitter can be improved, the dialogue output energy in the user's headset can be increased, and the dynamic range after removing the disturbing energy can be improved.

In the chain of signal processing reducing the undesired frequencies first allows the following processing to work more effectively.

B. Further improving dialog quality by applying techniques such as Aphex, and/or moderate bandpass filtering to favor the speech band, and/or moderate high frequency emphasis as desired.

C. Reducing the dynamic range of the remaining signal by increasing low amplitude valleys and reducing peak amplitudes, using "Companding" or a similar technique.

D. Increasing the amplitude of the transmitted signal based upon the above processing, thereby significantly improving the signal/noise ratio and increasing the available clear speech energy at the headset.

E. One or more outputs is provided with various delays to the hearing assist signal (s) as required for all or particular segments of a venue to reduce the timing disparity between the rapidly delivered hearing assist signal and the later perceived ambient (audience) sound.

It is significant to note that in trials conducted by the inventor, the above processing has dramatically improved the ability for severely hearing-impaired persons to enjoy the hearing-assist system, even over the standard headset. There is a perception that the dialog is magnitudes stronger and clearer through the same headsets than previously without the above processing. Previously such users were unable to understand anything through the headset and could only rely upon their special hearing aids with T-loop or other direct input, with mediocre results. Now, many prefer the clear sound through the hearing-assist headsets rather than their own special hearing aids.

The described enhancements can easily be added to an existing or new hearing-assist system of any type (such as wired, FM, infrared, inductive, wide area, Bluetooth, cell phone) or incorporated in a new system by those skilled in the art. Other variations will also be obvious to those skilled in the art.

The principles described herein can be applied to special situations to further increase the number of hearing-impaired that can be served in such venues.

As an example, consider a classroom found in many elementary schools for the severely hearing-impaired. The teacher will speak into a special FM frequency hearing-assist system and the signal is transmitted to special hearing aids worn by the students and equipped with an FM receiver and a microphone as well. For the young students, the microphone is left on at all times to allow them to stay in touch with their environment as they may also be too young to have the agility to turn on and off the microphone. In the small quiet classroom leaving the microphone on is not a negative.

Assume a venue desires to give hearing-assist service to these children by simulating their classroom environment. As part of this, a transmitter on the proper FM frequency can be installed and served by the signal processing described above. However, it is important to remember that the students' microphone will also be turned on. Therefore, the house ambient sound is injected into the students' ears at a very high and unnatural level. Under these conditions, as previously explained, there is only a very small tolerance of a few milliseconds that can be tolerated between the hearing-assist sound and the house sound. (This is just the opposite of using isolated headsets as previously described to attenuate the undesired house sound.) The inventor has discovered that the solution is to define selected adjacent rows of the theater as "classroom compatible". In this case the hearing-assist delay for these users must be precisely adjusted to correlate with the ambient sound in the designated rows. Trial results have been quite impressive with students being made capable of hearing for the first time ever in a theater, including those students with cochlear implants Therefore, the system embodying the present invention achieves its objectives in several steps: filtering out excessive unwanted energy, for example, the bass and low-mids as the first step for the hearing assist signal path. This now essentially leaves dialog energy (plus a little bass, moderate music and sound effects). The system then effectively applies additional enhancements to the dialog energy unencumbered by the excess bass energy or undesired energy which might 'fool' the subsequent processing. Such enhancements may include adding a small mid-high frequency boost in the frequency range common for hearing-impaired loss, adding automatic volume control, and reducing/attenuating the signal, as by companding (compression of high peaks, expansion of soft sounds), or the like (if excessive bass remained, it would overshadow the attempts to enhance the dialog energy), and other speech enhancement techniques as desired. A time delay can also be introduced to the hearing-assist signal so its timing correlates better with the ambient sound which was delayed due to propagation through the air and processing in the main house sound system.

The resulting vocal sound heard by the hearing-assist user is much louder. The total energy is the same, but the vocal energy is increased due to the lack of bass energy or other undesirable energy in the (hearing assist) signal stream.

The quality of sound reaching a hearing-assist user is further improved by the system embodying the present invention by modifying earsets which may be used by the user to include isolation elements. These earsets can be connected to the venue system by over-the-air communication or by patch cords as suitable. A cellular telephone might even be used to effect this venue-user connection.

The system of the present invention is most useful in large concert halls, such as are used for musical concerts, operas and musical plays. However, as those skilled in the art will understand, it can be used in any venue.

Another growing segment today of the hearing-impaired population has hearing aids which can accept an external input such as a line level audio input or T-loop inductive input. These users can be accommodated by a patch cord assembly or T-loop inductive adapter connected to the hearing-assist receiver in place of the headset previously described. In this case the user receives all the benefits described herein as well as additional customization afforded by his or her own hearing aid.

While the system embodying the preferred form of the invention is directed to speech as being the preferred component of the overall signal, those skilled in the art will understand that the teaching of this disclosure can be used to filter any signal to emphasize desired components and reduce, or eliminate, other undesired components of the signal. As such, speech as the desired component will be used herein as an example of the preferred form of the system with the understanding that the disclosure and claims associated therewith is intended to cover the situation where certain desired components of the signal are emphasized and undesired components are reduced or eliminated. This will be the situation of music being the desired component and the music component will be optimized, or where certain speech components are desired and other speech components are undesired, and the like as will occur to those skilled in the art based on the teaching of this disclosure. These situations are intended to be encompassed by this disclosure and the claims associated therewith.

This system allows reduction as much as necessary, such as 500:1, so there is something left so a user can hear the desired components of the overall signal but can also hear some of the undesired components if some portion of those components are desired. For example, this system will allow a user to hear dialog but also hear some music so the overall signal heard by the user is a mix, but a mix which emphasizes dialog so that music does not overpower the dialog and render the signal heard by the user as gibberish.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

The full nature of this invention will be understood from the accompanying drawings and the following description and claims.

DETAILED DESCRIPTION OF THE INVENTION

Figure 1:
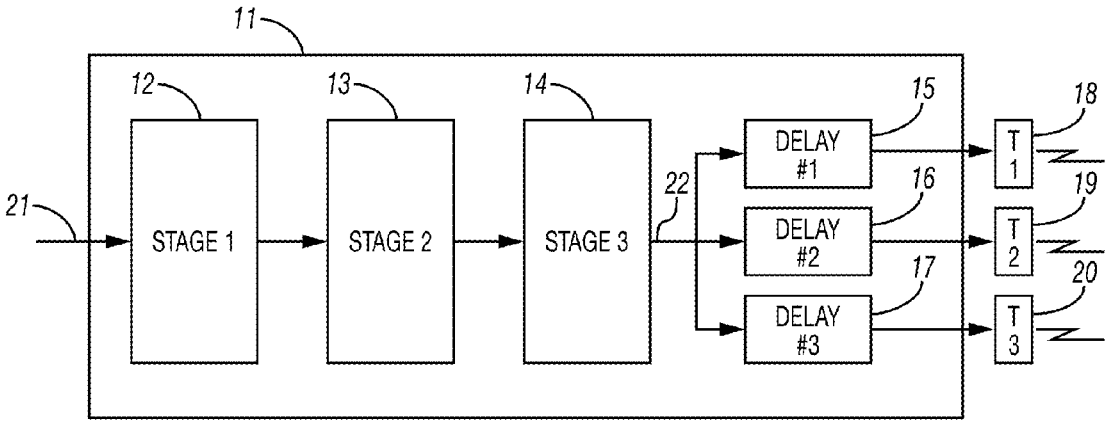
FIG. 1 is a block diagram of the system according to this invention and is a typical embodiment thereof.

The present description is made with reference to the accompanying drawings, in which example embodiments are shown. However, many different embodiments may be used, and thus the description should not be construed as limited to the embodiments set forth herein. Rather, these embodiments are provided so that this disclosure will be thorough and complete. Like numbers refer to like elements throughout.

As explained above, the sound heard by a hearing-impaired, hearing-assist user in a large venue may be muddled and garbled. This muddled, garbled sound heard by a hearing-impaired, hearing-assist user in a large venue is a result of several problems. There may be an 'overdose' of bass/mid-low frequencies that the hearing-impaired person receives whereby the bass/low frequency sounds mask the dialog sounds so the dialog is rendered inaudible to the hearing-assist user. The reasons for the overdose are (A) the hearing-assist headset is transmitting the bass and mids, (B) the house system is also transmitting the bass/mids and is heard by the hearing-impaired person through his ears and via body/bone conduction, (C) house reverberation tends to add to the bass energy and create a boom, and there is a timing difference between the headset sound and the ambient, further causing an overall smearing and further loss of intelligibility. Also, a hearing-impaired person may tend to have a hearing loss of mid-mid-high frequencies important for speech, putting the bass even more predominate. Masking of desired sounds by undesired sounds (maskers) can be a function of frequency, both absolute and relative, as well as the loudness level of both the masker and the masked signal and the bandwidth of the masking sound. The system of the present invention permits a venue to control parameters so such masking is minimized and the desired signals reach the listeners.

More specific examples will be presented herein below.

Home or Classroom Hearing-Assist Situation

In the typical home or classroom environment, the effect of the ambient room sound is not of concern because it is typically not excessively loud and may be considered in sync with the headset sound since the rooms are small enough that propagation delay of airborne sound from a TV or teacher's voice to the listener is of no concern.

For example, consider the electronic transmission of sound to a user's headset to be virtually instantaneous. Propagation delay for sound traveling through air is approximately (for ease in this discussion) 1 ms per foot. If a hearing-impaired student is sitting at the back of the classroom perhaps 20 feet from the teacher, the delay until the teacher's direct sound reaches the student as compared to an instant electronic sound is only 20 ms. Additionally, it is of lower volume. Under these conditions the ear and brain assumes the delayed sound is a typical echo and it correlates it with the main sound so no disturbing echo or loss of intelligibility occurs. (Psycho-acoustically, single low level echo delays of up to about 80 ms can be tolerated by most people, so 20 ms delay under these conditions is easily tolerable.) Further, the ambient environment is quiet and the headset audio is relatively undistorted because the only energy being amplified is the teacher's voice. Thus low-cost headsets that do not attenuate ambient sound or even a one-ear headset may be used. Further, in these situations, the dialog/speech energy prevails which is important for the hearing-impaired person to understand the essence of what is taking place.

In addition to the air-borne delay, most larger venues employ loud, sophisticated sound systems with digital processing and loud speakers, for example, located far above the stage. The added distance and processing may add another delay of perhaps 30-40 ms.

In summary, the 'good environment' of the classroom or similar environment for this illustration:

1. Has no delay or timing conflicts between instantaneous electronically delivered sound and the later ambient sound.

2. Does not have a loud amplified ambient venue sound (including delays and echoes) which may be even louder than the main headset sound—a situation that reduces the brain's ability to provide intelligibility.

3. Does not have excessive music and heavy bass energy-either in the hearing-assist sound stream or the ambient room sound—which would further greatly interfere with intelligibility and may cause distortion to the hearing-assist system itself. (It is of interest to note that many performance directors of musical shows purposely make the music louder than the words of a song. That is so patrons go home humming the melodies which sells musical purchases. Reciting the words would not sell musical purchases as well.)

4. Does not have excessive reverberation created by the larger size room of a venue and its hard surfaces. Reverberation may be thought of as a series of long decaying echoes or energy at particular frequencies caused by the sound bouncing off of hard surfaces such as walls, ceiling and flooring. Echo and reverberation of lower and mid frequencies is especially bothersome. This tends to appear to lengthen bass notes etc. so that the energy is available for a longer time to interfere with the desired voice energy. This further interferes with intelligibility and adds to the common complaint that 'the music is too loud to understand the words'.

5. Does not have an excessively wide dynamic range of music and sound effects which may further cause system distortion and be painful to the listener.

6. Does not have the talker's or other microphone(s) further picking up the ambient disturbances as above and reentering them into the system as more extraneous energy.

A common misconception is that the hearing-impaired person does not hear any of the ambient venue sound. This is not true and is a major part of the problem that exists when a classical (i.e. classroom) hearing-assist system is installed in a theater, church or similar venue. There are many audio inputs that a hearing-impaired person may still receive directly which ultimately can interfere with the dialog intelligibility hopefully afforded by the hearing-assist system. These include:

A. Near normal hearing in one or both ears. (Many people with normal or near-normal hearing often request hearing-assist headsets just to better understand and enjoy a performance. This population too is well-served by this invention.)

B. Hi frequency loss only. This is a very common situation, especially with age or repeated exposure to high volume concerts. The continued low frequency response admits considerable disturbing energy which masks dialog and greatly interferes with intelligibility.

C. Body and bone conduction which directly admits disturbing low frequency energy to the inner ear.

D. Hearing aid amplification increasing the amplitude of ambient house sound at the same time hearing-assist sound is being received. This is because certain hearing aids have the dual or greater capacity to electronically receive the hearing-assist signal and at the same time their microphone may pick up the ambient house sound. Besides the general 'loud ambient noise', this may create an ambient sound and/or echoes plus reverberation actually louder than the main microphone signal. This is an unnatural situation to the brain. The result may be 'gibberish' or sound like two or more separate voices saying the same thing a fraction of a second apart. Intelligibility is virtually impossible. By experiment, under these conditions the inventor has found that only 10 ms-20 ms or less between the echo and main signal can be tolerated as compared to about 80 milliseconds for a conventional lower-level delayed echo.

Live Theater, Movie or Church and Similar Venues

There are many ways in which the hearing-impaired person can still hear all or portions of the ambient sound presented to the audience at large. For example, one might consider how very loud movie sound, live theater or concert sound may be as compared to the benign quiet ambient sound in a classroom or home. In addition, it should be remembered that the hearing-impaired person is also receiving sound at the same time electronically via the hearing-assist system. Most often the ambient and hearing-assist sounds are at conflict with each other, especially with regard to intelligibility which for the hearing-impaired person may be virtually impossible.

Using the same numbering as above for the classroom environment, the conflicts that exist in these environments as compared to the quiet classroom environment for the hearing-impaired person can be considered.

1. The hearing-assist sound is electronically transmitted from the source and arrives virtually instantaneously at the user headsets. In the theater/church/movie/concert venues there is typically a powerful house sound amplification system. The system may contain various inherent delays due to digital signal processing and the loudspeakers are often elevated and away from even the first row of the audience, further creating propagation delay of the air-borne sound. Thus there may be a delay of perhaps 30 ms before the loud amplified ambient sound reaches even the first row of the audience. Although the ear and brain might typically deal with delays of this magnitude with regard to soft echoes, this ambient amplified sound may be so loud as compared to the headset sound that the brain is compromised in trying to correlate the signals and intelligibility suffers or the user must subconsciously strain to try to understand the dialog and hence the event. This strain becomes uncomfortable and enjoyment of the event suffers. The further back one sits from the front row additional propagation delay is added, making the problem even worse. Eventually a point is reached, perhaps 50 feet from the stage or podium, where the hearing-assist dialog intelligibility is virtually destroyed because of the long delay and high level of the ambient sound as compared to the instant sound in the headsets.

The solution to this problem is to introduce a time delay in the hearing-assist system. In this example assume a delay of 40 ms could be added to the hearing-assist sound. Now the time correlation between the ambient and headset sound is greatly improved, reducing or eliminating the intelligibility problem. Finally the point of loss of intelligibility which was at 50 feet before is now at approximately 90 feet which may include the entire theater as an acceptable intelligibility zone. For larger venues, additional hearing-assist transmitters and receivers on different frequencies with longer delays as necessary maybe added to accommodate the rear sections of the venue with regard to keeping the timing of the hearing-assist and ambient sounds close enough for good intelligibility 2,3,4. The mere presence of a high noise ambient house sound with added echoes and reverberation interferes with the clear hearing-assist signal. This is one reason some people who have been at a movie, concert or theater event and not been able to understand the dialog due to the loud music or sound effects—including such a high level of sound that an audience member's ears may actually distort from it. All this is worse for the hearing-impaired person in addition to the timing conflicts previously discussed. Especially if the hearing-assist signal is wide-range, a situation is created of excess bass, further interfering with intelligibility.

A properly designed hearing-assist headset can help mitigate these problems. The headset should provide sound to both ears and contain a degree of isolation to reduce the ambient noise level perceived by the hearing-impaired user.

3,5,6. For the house sound, a show's director may specify a mix with very loud levels of music, bass and sound effects as compared to dialog. This alone may be troublesome to a person with normal hearing. This same mix is typically fed to the hearing-assist system, and it's effects are far worse for the hearing-impaired person if the response is 'flat' and includes bass frequencies at full amplitude. For example, if the hearing-impaired person's hearing loss is at high frequencies the excessive bass becomes even more disturbing in masking dialog than it would be for a person with normal hearing. The wide dynamic range of a typical mix may cause headphone and system distortion and even discomfort or pain to the user. Excessive bass energy and wide dynamic range may introduce yet another problem to the hearing-assist system-reduced signal to noise ratio. The maximum transmitter level must be set according to the maximum expected instantaneous signal. This may be much louder than the dialog energy. Thus the dialog energy may be transmitted at a relatively low level. This reduces the dialog signal to noise level ratio at the receiver and makes the system sound static prone or noisy and further inhibits ability to understand dialog.

Figure 8:
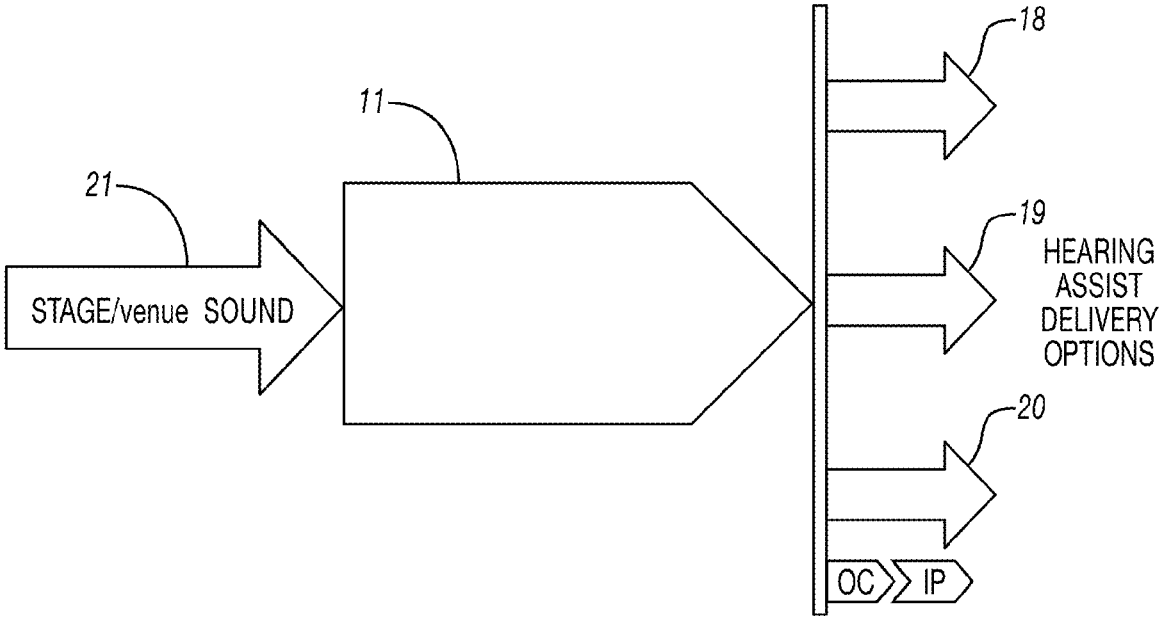
FIG. 8 shows an overview of the system embodying the teaching of the present invention.
Figure 9:
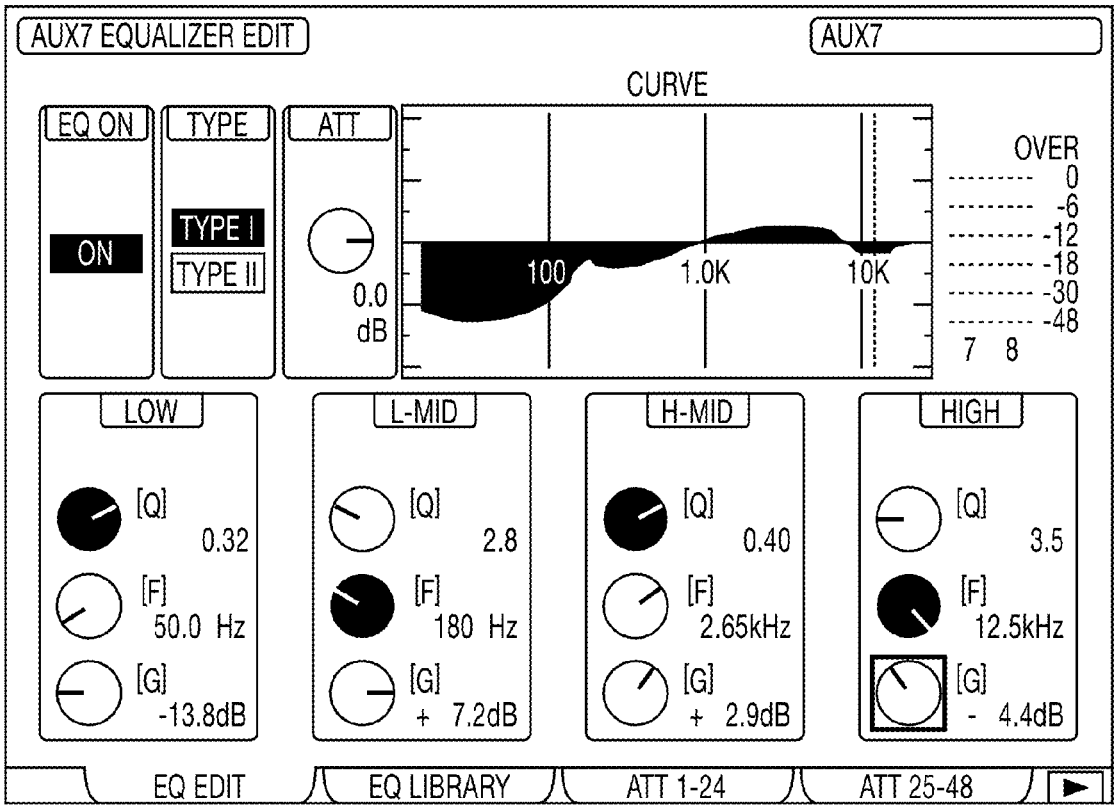
FIG. 9 shows a BSS Processor display suitable for use with the system embodying the present invention.

Specific implementation details of the invention will now be given. Referring first to FIGS. 1 and 8, the main processing unit, 11, contains the processing used to modify the input sound, 21, to a form more suitable for hearing assist applications, 22. The various processing stages, 12, 13, 14, 15, 16, 17 may be accomplished by discrete componentry or state-of-the-art digital sound processors such the such as those manufactured by BSS. One skilled in the art will find a large variety of options available and may modify this example as required for the particular installation at hand. A BSS processor display suitable for use in the system embodying the present invention is shown in FIG. 9.

An example of a quick control screen can be found in BSS London Architect., (http://bssaudio.com/en-US/softwares/hiqnet-london-architect-v6-00-r4-windows), the disclosure of which is fully incorporated herein by reference. This unit has been modified for use in this system. The processing chain includes an input mixer/router which then passes through signal prefiltering. (Highpass and corrective EQ). The prefiltered signal then passes through a 4-way multiband compressor and a parallel compressor. The multiband compressor forces a general tonal shape and balance across the frequency spectrum and the parallel compressor decreases the dynamic range of the signal. Basically, the two compressors work to make the average signal louder by reducing the difference between peaks and nominal and also provides additional separation between foreground and background noises. The compressed and filtered signal passes to the output stage where gain, EQ, and delay can be applied to suit the venue dimensions and correct for differences in assistive listen transmitter/receiver combinations.

Figure 2:
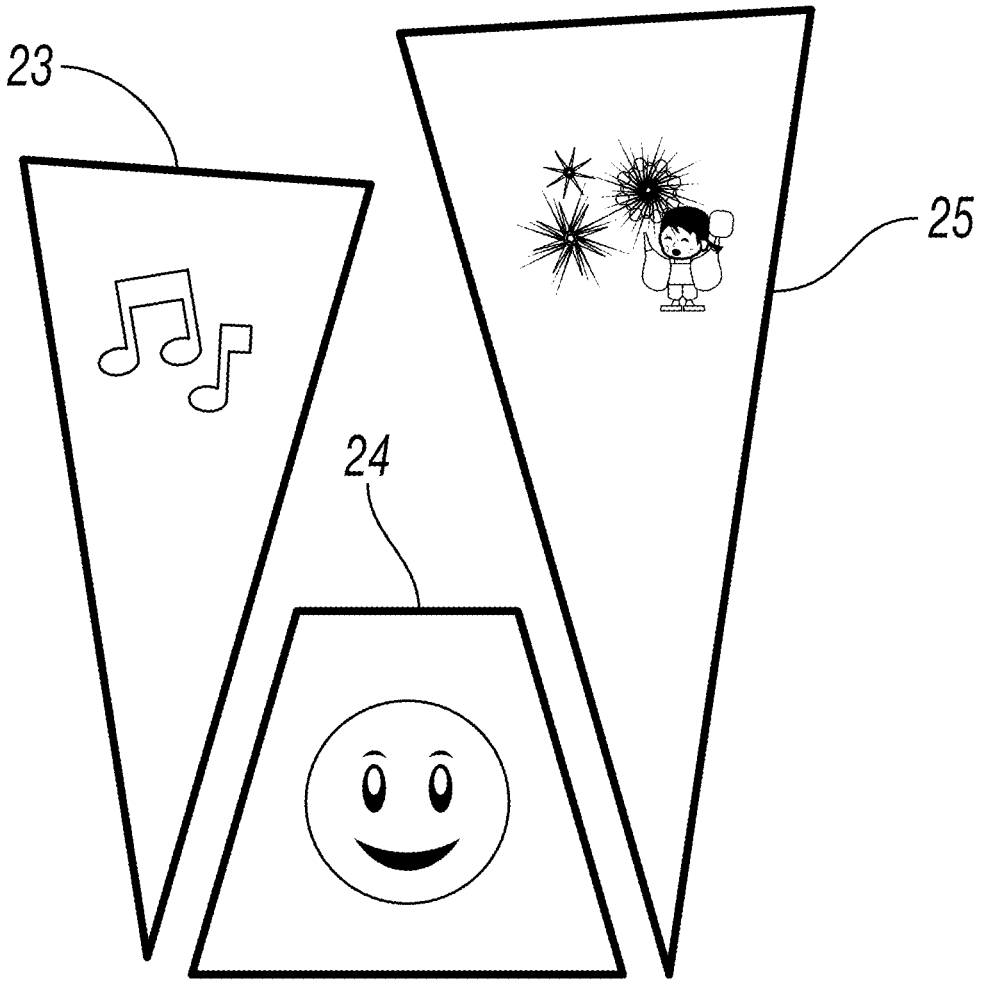
FIG. 2 is a representation of a typical "Director's mix" of sound as presented to a theater, church, movie or similar venue house public address sound system as well as the venue's hearing assist system(s).
Figure 3:
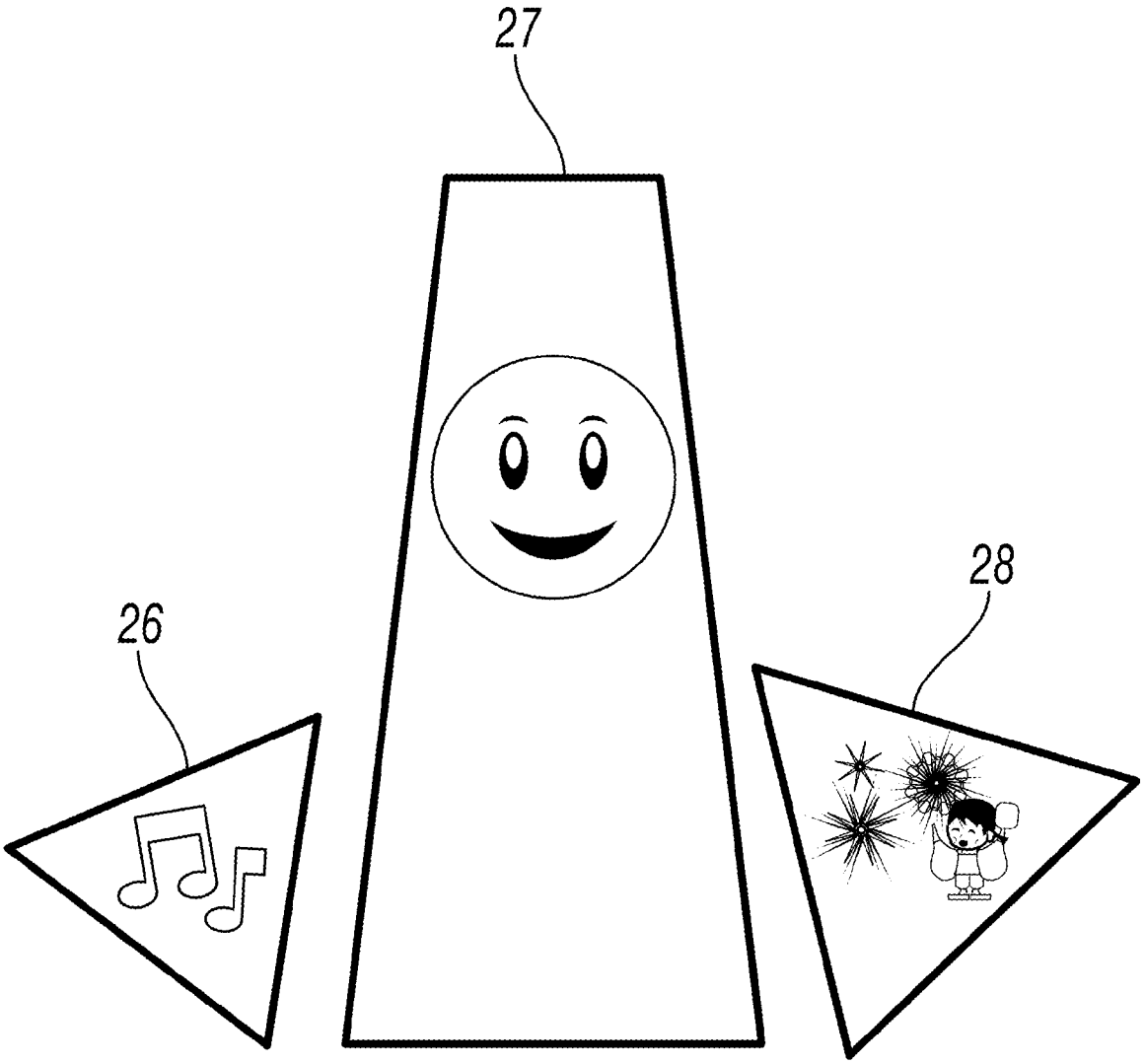
FIG. 3 is a representation of a typical mix of sound presented to the hearing assist systems after processing by this invention.

The input signal, 21, is typically the same input signal as furnished to the house public address sound system. FIG. 2 describes the components of this input signal. It may contain music components, 23, such as high-energy low bass notes which may be destructive both to ongoing signal processing and to intelligibility for the hearing impaired listener. This energy may often be much greater than the important dialogue/speech energy, 24. Similarly, sound effect energy, 25, may often be greater than dialogue energy. FIG. 3 illustrates the energy balance after processing. The music energy, 26, and sound effect energy, 28, are in better balance with the important dialogue energy, 27. This balance creates a situation for the hearing impaired user such that comfort against loud noise peaks and intelligibility is dramatically improved.

In this example the function of the first processing stage, 12, is to reduce high-energy components not required for intelligibility by the hearing impaired person. For example, this may be excessive musical bass notes which would cause an "overdose" of bass energy to the user since the bass notes are also received by bone conduction and leakage through headsets from the house sound system. This excessive bass energy, often made worse by reverberation spreading the energy in the time domain, can greatly reduce intelligibility and cause subsequent distortion both electronically and physically to the ear as well as a poorer signal/noise ratio to the user.

The second processing stage, 13, further optimizes the desired speech components, such as applying filtering to accentuate significant speech frequencies or reduce frequencies outside the typical speech band, adding a moderate amount of high frequency energy to compensate for common high-frequency loss, especially in the speech band or employing speech enhancement techniques such as APHEX or other approaches often used in broadcast systems.

The final processing stage, 14, applies a suitable reduction/attenuating technique, such as companding (compression of high amplitude signals, expansion of low amplitude signals) or similar processing to reduce the resultant dynamic range. This further improves overall performance by providing a better comfort level to the user, and an increased signal to noise ratio when transmitted over a typical hearing assist system and reduced distortion along with a louder signal of interest (such as dialog) within the hearing assist system including the headset.

Finally, various stages of delay are added, 15, 16, 17 as required for each section of the venue via its specifically related hearing assist transmitter/receiver system, 18, 19, 20 to improve the time correlation between the ambient house sound and the instantaneous electronic sound in the particular section of the venue served by the respective transmitter as required due to system and propagation delay. As discussed above, a user's brain can accommodate a delay of as much as 80 ms; therefore the system of the present invention can introduce delays in the signal so that the signal from the system reaches the user within a preselected time delay, with the just-mentioned 80 ms delay being an example of the preselected time delay.

As an example, hearing assist transmitter, 18, may service patrons in the front of the venue and they will be furnished with a receiver tuned to the frequency of transmitter 18. Transmitter 19 may service a "classroom compatible" section of the venue where elementary school youth use hearing aids equipped with FM receivers and activated microphones, with the respective transmitter tuned to the frequency of the students' FM hearing aids and the respective delay optimized for that precise area of the venue. (Severely hearing-impaired adults with similar hearing aids may be able to sit anywhere in the venue since they can turn off their microphone and not hear the venue's ambient sound.) Transmitter 20 may serve patrons in the rear of the venue with delay 17 set accordingly and frequency of the patron's receivers in that area set to the transmitter's, 20, frequency.

Figure 4:
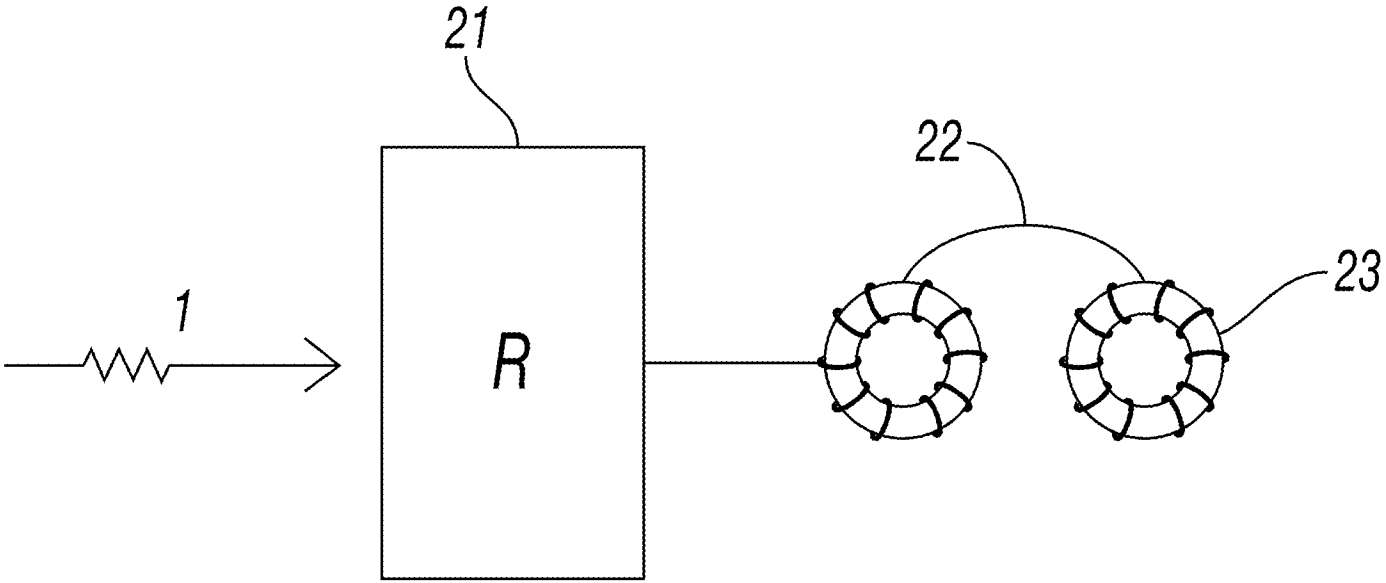
FIG. 4 is a typical hearing assist receiver with headphones as claimed in this invention.
Figure 5:
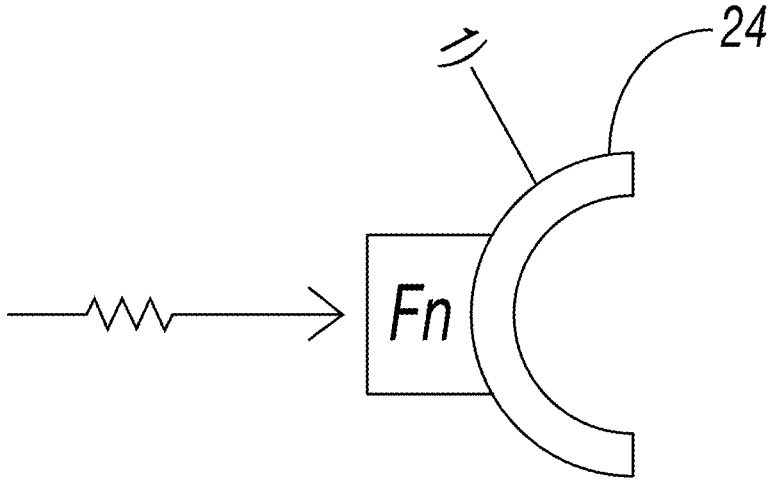
FIG. 5 is a special hearing aid often used by students in specially equipped classrooms for severely hearing-impaired youth as well as other severely hearing impaired individuals.
Figure 6:
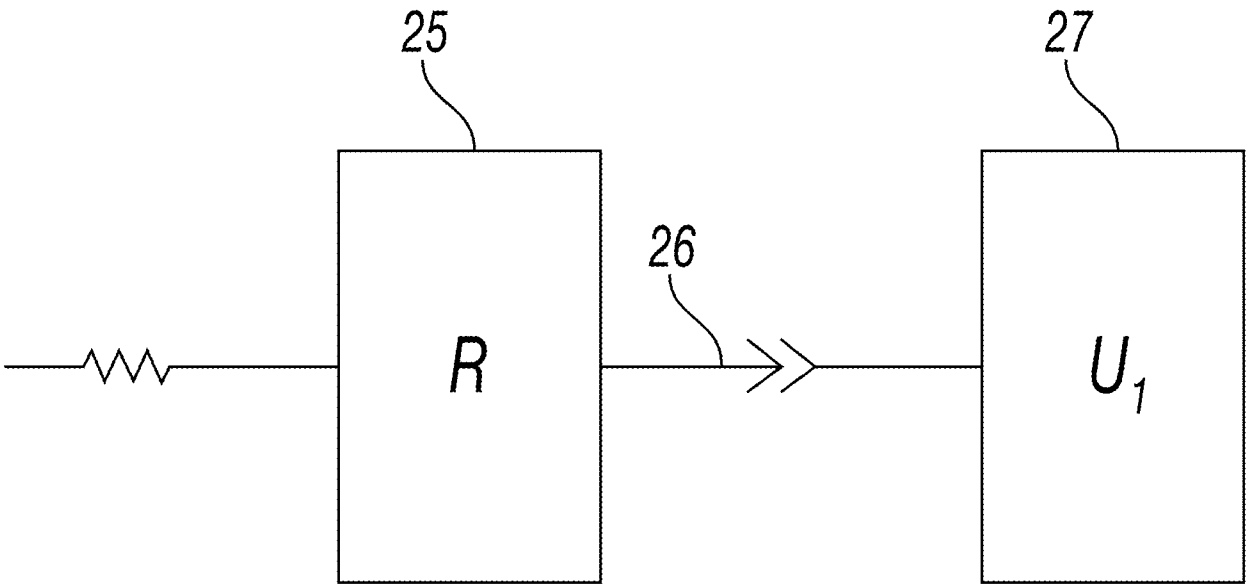
FIG. 6 illustrates hearing aids and related devices, such as streamers which accept a direct electrical input from an external source.
Figure 7:
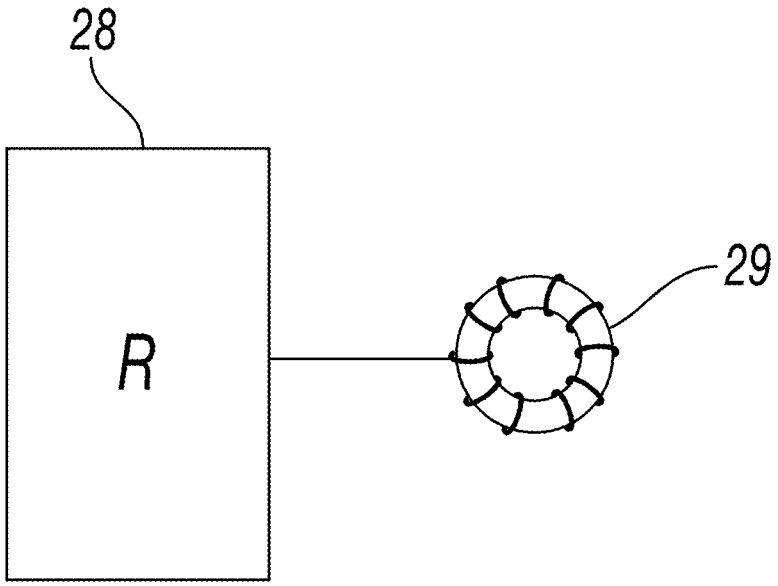
FIG. 7 illustrates and adapter device to allow a T-Loop equipped hearing aid to receive a magnetic T-Loop signal from a standard hearing assist receiver having a headset output.

Various delivery options complete the furnishing of the improved sound to the various hearing impaired users. In FIG. 4 receiver 21 provides an output signal to headset 22 which is equipped with foam isolation, 23. The function of isolation 23 is to reduce the level of the ambience house sound. This further improves intelligibility and increases the user's margin to tolerate echoes by lowering their amplitude. It also helps mitigate against an overdose of low-frequency base energy interfering with intelligibility. In FIG. 5 the "class room compatible" FM signal is received directly by hearing aid 24 which may also include a microphone and output to a cochlear implant. In FIG. 6 the receiver, 25, may be equipped with a patch cord output, 26, which may interface directly into various modern hearing aid inputs such as line inputs or intermediate devices such as streamers, 27, which mix various signals together such as cell phone, Bluetooth and microphones that, for example, a severely hearing impaired user may place directly in front of his table partners in a noisy restaurant. In FIG. 7 receiver 28 supplies a device, 29, known as a T Loop adapter. This adapter contains a magnetic coil which delivers a magnetic field of the hearing assist audio to a corresponding coil in the hearing aid which is known as a T Loop receiver.

Suitable hearing assist transmitters and receivers are available from a variety of sources such as Listen Technologies.

Other variations similar to the above will be obvious to one schooled the art; including accommodating interfaces to new hearing devices they become available in the future.

As one such example consider the use of cell phones as hearing assist receivers. Hearing assist transmitters 18, 19, 20 could be replaced by telephones with line input capability to accept their respective input signals. The telephones could then be connected to existing conference services. Cell phone users in the venue audience could dial the respective conference number and hence be connected to the desired hearing assist signal. These might be standard cell phones or cell phones special-purposed for the hearing impaired. Another variation might use the Wi-Fi functionality of a cell phone within the venue transmitting a Wi-Fi hearing assist signals. Further, the hearing-assist headsets may be equipped with inductive coupling and the system embodying the present invention includes circuitry (TC in FIG. 1) for connecting a user's headset to the hearing assist system via the inductive coupling.

In summary, the system embodying the present invention completes the following steps to achieve its goals.

1. Start with the house sound feed and remove or reduce unwanted energies. Three main reasons are:
   a. To reduce sonic overload at the user with regard to sounds typically received through the hearing assist system and the house ambient sound. That creates a muddle heard by the hearing-assisted audience member in a large venue, such as a concert or symphony hall or large church.
   a. After this reduction, the remaining electrical signal is composed primarily of the dialogue or other desired frequencies. Thus, subsequent processing can concentrate on the desired dialogue without being distorted or confused by the unwanted energy. For, example an unremoved bass boom could fool a compressor circuit so that it would reduce the dialogue at the time of the boom, clearly the situation that would hurt or destroy intelligibility at that time.
   c. Permit the headset or other transducer device to achieve a louder volume of the desired frequencies without the distortion or dangerous loud levels that may be caused if excessive undesired energy were also present at the headset or trannsducer.
2. Next, the system processes the audio un-encumbered by excess energy that is unwanted in with the processing optimized for the needs of the hearing impaired users.
3. The system then takes the optimized electrical signal and provides a number of output channels as needed. Each channel can include appropriate delay circuitry as needed for a specific purpose. For example the delay can create better general time alignment between the house sound and hearing assist sound. This further gets rid of the muddle and enhances intelligibility.
4. Next, the system includes various transmitting means based on how the sound is to be delivered. For example, the delivery system might include different FM transmitters, connection to a wide area network, etc.
5. Finally the system can include various options at the user's end. For example headsets covering both ears, or headsets with the foam isolation to further reduce the ambient sound, or patch cables to interconnect the system hearing assist receiver to a user's personal hearing devices (for example, a 'relay transmitter' or magnetic adapter to couple the hearing assist sound directly into his/her hearing aid.

The system embodying the present invention can also be used for the following applications.

1. Frequency optimization for music for the hearing impaired. What was described above with respect to dialog will work in a similar manner for music alone. There might be a slight change in frequencies, but the remaining music for a hearing-assist user will still be worthwhile.

2. The system embodying the present invention can also be used with echo suppression and noise reduction on the input signal, especially for situations where the key actors in the venue are not wearing wireless mics so their voices are picked up only a few inches from their mouth. Wireless mics do a lot to increase the signal to noise ratio for dialog. However, in many smaller or low cost venues there are only hanging or floor mics to pick up the actors. The voice sounds further away and the mic is also picking up room reverberation and echoes. These are damaging to everyone (even hearing able audience members often have trouble understanding dialog in these theaters); however, this is especially damaging to the hearing impaired person because the reverberation and echoes may be in the frequency range where their hearing is still most sensitive-further covering up their weaker high frequency dialog intelligibility reception. The above-described system may be modified by adding additional processing steps for these cases when the actors do not use wireless mics. Examples may be (1) echo suppression (borrowed from the telephony world where echo suppressors are used to stop echo from the distant phone), (2) additional filtering of frequencies responding to that venue's reverberation frequencies, (3) volume compression of frequencies related to room reverberation or other lower energy random noise, (4) other intelligibility enhancements.

The system embodying the present invention can also be adapted for binaural hearing for the hearing-assisted audience members. That is, binaural hearing occurs when a listener receives different inputs from each ear. The listener's brain will fuse the two inputs to form a simple, coherent auditory image which is a function of the difference in the two signals. One difference is, as has been discussed above, the time delay between signals. The time delay for signals received from each side of a venue can be controlled. If properly controlled, a hearing-assisted audience member can receive auditory signals in each ear that will exactly simulate the signals a hearing audience member receives. The stereophonic effect will be similar for both the hearing-assisted audience member and the hearing audience member thereby enhancing the experience for the hearing-assisted audience member. The noise, or masking signal, can also be controlled from each side of the venue so that such unwanted signals arrive at the user in a timed sequence so that the listener's brain compensates and the unwanted signal is ignored by the listener in a phenomena known as masking level differences (MLDs) and can be used to squelch noise and reverberation by binaural hearing.

In some cases, certain users may have headsets which can be directly attached to the system of the present invention by means of an input plug (IP in FIG. 8). In such cases, the system can further include hearing-assist receiver output circuitry (OC in FIG. 8), and the headset will include an input plug (IP in FIG. 8) to which the cable is attached to connect the headset to the hearing-assist receiver output circuity.

The system may be used in environments where 'local ambient echoes' because of strength or excessive time delay such that the brain does not integrate them out (approximately 80 ms or longer) to delay the original signal transmitted by the hearing assist system until it is essentially coherent with the local echoes and can therefore be integrated by the brain and the speech or other audio signal understood.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A hearing-assist system for use in a venue which contains ambient sounds, the system comprising:

(a) a processing unit which is connected to an electronic venue sound system in a venue to modify that sound from the venue sound system to a sound signal appropriate for hearing-impaired users in the venue, the processing unit including (1) a first processing stage connected to the electronic venue sound system to receive signals from the venue sound system and including circuitry which reduces selected high-energy components of the sound from the venue sound system and produces a first signal, (2) a second processing stage connected to the first processing stage to receive the first signal and including circuitry optimizing selected components of the first signal and produces a desired component-optimized signal, and (3) a third processing stage which receives the desired component-optimized signal from the second stage and includes circuitry to reduce dynamic range of the desired signal and generate a customized signal; and (b) venue-specific circuitry receiving the customized signal from the third processing stage and relaying that signal to a hearing-impaired user in the venue.

2. The hearing-assist system defined in claim 1 wherein the venue-specific circuitry includes circuitry for applying a time delay to the customized signal from the third processing stage.

3. The hearing-assist system defined in claim 2 further including a plurality of venue-specific circuitry, with each of the plurality of venue-specific circuitry applying a time delay appropriate to a specific location in the venue so that a customized signal from the third processing stage reaches a hearing-impaired user simultaneously with an ambient signal in the venue associated with the customized signal.

4. A hearing-assist system for use in a venue in which ambient sounds contain desired components as well as other components, the system comprising:

(a) a processing unit which is connected to an electronic venue sound system in a venue to receive sound signals from that venue sound system and modify that sound from the venue sound system to a sound signal appropriate for hearing-impaired users in the venue, the processing unit including first circuitry for reducing selected frequencies in the signal received from the venue sound system to frequencies below a selected level, circuitry connected to the first circuitry to receive signals from the first circuitry and improving quality of desired components of the signal and generating a desired component optimized signal, and third circuitry connected to the second circuitry to receive desired component-optimized signal from the second circuitry and reducing the dynamic range of the desired component-optimized signal, and (b) venue-specific circuitry connected to the third circuitry to receive the optimized signal from the third circuitry and relaying that optimized signal to a hearing-impaired user in the venue.

5. A hearing-assist system for use in a venue in which ambient sounds contain desired components as well as other components, the system comprising:

(a) a processing unit which is connected to an electronic venue sound system in a venue to receive sound signals from that venue sound system and including signal-energy modifying circuitry which receives sound signals from the venue sound system and which reduces selected energy components from the signals received from the venue sound system and generates a desired component-focused signal, (b) signal-optimizing circuitry connected to the signal-energy modifying circuitry to receive desired component-focused signals and which optimizes the desired component-focused signal for needs of hearing-impaired users and generates an optimized signal, (c) delay circuitry connected to the signal-optimizing circuitry to receive the optimized signal and delay the optimized signal according to a pre-set delay, and (d) signal-transmitting circuitry connected to the delay circuitry to receive the delayed optimized signal from the delay circuitry and transmit that signal to a hearing-impaired user in the venue.

6. The hearing-assist system defined in claim 5 further including signal-receiving circuitry for receiving the signal transmitted by the signal-transmitting circuitry, and a headset which is worn by the hearing-impaired user and which is connected to the signal-receiving circuity.

7. The hearing-assist system defined in claim 6 further including hearing-assist receiver output circuitry, an input plug on the headset and a cable connecting the headset to the hearing-assist receiver output circuity.

8. The hearing-assist system defined in claim 6 wherein the headset includes a sound-isolating element.

9. A hearing-assist system for use in a venue in which ambient sounds contain dialog as well as other components, the system comprising:

a processing unit which is connected to an electronic venue sound system in a venue to receive sound signals from that venue sound system and modify that sound from the venue sound system to a sound signal appropriate for hearing-impaired users in the venue, the processing unit including signal-optimizing circuitry connected to the venue sound system to receive signals from the venue sound system and reduce pre-selected energy frequencies from the signal received from the venue sound system and generate dialog-focused signals, and signal-transmitting circuitry connected to the signal-optimizing circuitry for receiving dialog-focused signals and transmitting the dialog-focused signal to a hearing-impaired user located in the venue.

10. The hearing-assist system defined in claim 9 wherein the signal-transmitting circuitry includes delay circuitry for delaying the dialog-focused signal received from the signal-optimizing circuitry by a pre-set time so that the dialog-focused signal arrives at the hearing-impaired user within a preselected time frame with ambient sounds in the venue which correspond to the dialog-focused signal received via the processing unit.

11. The hearing-assist system defined in claim 10 wherein the pre-selected energy frequencies correspond to bass/mid-low frequencies that the hearing-impaired user hears in ambient sounds.

12. A hearing-assist system for use in a venue in which ambient sounds contain dialog as well as other components, the system comprising:

a processing unit which modifies sound heard by a hearing-assist unit worn by a user when that user is attending an event in a venue, the processing unit including (1) signal input circuitry for receiving an input signal from a program source feed in an event occurring in the venue, (2) signal modifying circuitry connected to the signal input circuity and which includes signal-energy processing circuitry which reduces selected high-energy components from the input signal and produces a dialog-focused signal, (3) signal-optimizing circuitry connected to the signal input circuity to receive the dialog-focused signal and which modifies the dialog-focused signal by accentuating certain energies of the input signal and reducing certain other energies of the input signal to optimize the signal for the hearing-assist unit worn by the user, and (4) dynamic-range reducing circuitry connected to the input signal circuitry and which applies reduction/attenuation to reduce the dynamic range of the input signal.

13. The hearing-assist system defined in claim 12 further including signal-modifying circuitry connected to the input signal, the signal-modifying circuitry controlling time correlation between ambient sound in the venue and the signal received by the user via the hearing-assist system.

14. The hearing-assist system defined in claim 13 wherein the signal-modifying circuitry further includes sound-customizing circuitry for customizing the signal received by the user via the hearing-assist system in the venue so the sound heard by the hearing-impaired user in the venue simulates sound heard by the user in an environment different from the venue.

15. The hearing-assist system defined in claim 12 further including an ambient-sound isolation element which is worn by the user to physically attenuate the signal received by the user via the hearing-assist system from ambient sounds in the venue.

16. The hearing-assist system defined in claim 12 further including a cord for directly connecting a user's headset to the hearing-assist system.

17. The hearing-assist system defined in claim 12 further including circuitry for connecting a user's headset to the processing unit via a cellular telephone network.

18. The hearing-assist system defined in claim 1 wherein the desired component is speech.

19. The hearing-assist system defined in claim 12 further including circuitry connecting a user's hearing aid to the processing unit via inductive coupling.

20. A hearing-assist system for use in a venue which contains ambient sounds, the system comprising:

(a) a processing unit which is connected to an electronic venue sound system in a venue to modify that sound from the venue sound system to a sound signal appropriate for hearing-impaired users in the venue, the processing unit including (1) a first processing stage connected to the electronic venue sound system to receive signals from the venue sound system and including circuitry which reduces selected high-energy components of the sound from the venue sound system and produces a first signal, (2) a second processing stage connected to the first processing stage to receive the first signal and including circuitry optimizing selected components of the first signal and produces a desired component-optimized signal, and (3) a third processing stage which receives the desired component-optimized signal from the second stage and includes circuitry reducing the dynamic range of the desired component-optimized signal and generates a customized signal; and (b) venue-specific circuitry receiving the customized signal from the third processing stage and relaying that signal to a hearing-impaired user in the venue.

21. The hearing-assist system defined in claim 6 further including a cord connecting the headset to the signal-transmitting circuitry.

22. The hearing-assist system defined in claim 5 further including a user personal hearing assist signal input circuity and circuitry connecting the user personal hearing assist signal input circuitry to the signal-transmitting circuitry.

23. The hearing-assist system defined in claim 22 wherein the circuitry connecting the user personal hearing assist signal input circuitry to the signal-transmitting circuitry includes a wireless reception means.

* * * * *